US006659450B2

(12) United States Patent
Fukasawa et al.

(10) Patent No.: US 6,659,450 B2
(45) Date of Patent: Dec. 9, 2003

(54) SHEET FEEDING APPARATUS AND AUTOMATIC DOCUMENT USING THE SAME

(75) Inventors: Eiji Fukasawa, Yamanashi-ken (JP); Mizuho Shirakura, Yamanashi-ken (JP); Osamu Jinza, Yamanashi-ken (JP); Makoto Iino, Kofu (JP)

(73) Assignee: Nisca Corporation, Yamanashi-ken (JP)

( * ) Notice: Subject to any disclaimer, the term of this patent is extended or adjusted under 35 U.S.C. 154(b) by 69 days.

(21) Appl. No.: 09/986,466

(22) Filed: Nov. 8, 2001

(65) Prior Publication Data

US 2002/0096819 A1 Jul. 25, 2002

(30) Foreign Application Priority Data

Nov. 8, 2000 (JP) ..... 2000-340223

(51) Int. Cl.[7] ..... B65H 3/52
(52) U.S. Cl. ..... 271/121
(58) Field of Search ..... 271/10.11, 3.14, 271/104, 121, 137, 167, 277; 400/578, 624; 347/216; 358/498

(56) References Cited

U.S. PATENT DOCUMENTS 5,921,542 A * 7/1999 Ohno et al. ..... 271/121
5,938,109 A * 8/1999 Sainz et al. ..... 229/120.21
6,025,936 A * 2/2000 Ishida ..... 358/498
2002/0060397 A1 * 5/2002 Endo ..... 271/121

FOREIGN PATENT DOCUMENTS

EP 0 281 073 * 9/1988 ..... G03G/15/00
JP 3-205241 * 9/1991 ..... B65H/3/52

* cited by examiner

*Primary Examiner*—Donald P. Walsh
*Assistant Examiner*—Kenneth W Bower
(74) *Attorney, Agent, or Firm*—Kanesaka & Takeuchi

(57) ABSTRACT

A separation unit is formed of a feed roller that touches the uppermost surface of sheets stacked on a sheet supply tray to feed the sheet, a supply roller to supply the drawn out sheet, and a separating member pressing against the supply roller to allow only the uppermost sheet to pass. A guide member is disposed between the sheet supply tray and the separating member with an angle with respect to the sheet supply tray to guide the sheet to the supply roller and abut against leading edges of the sheets drawn out from the feed roller to separate them. The separating member of the separating mechanism and the guide member are attached and detached as a single body to the guide member for guiding the sheets. Therefore, while high separation performance for the sheets can be maintained, workability in replacing the separating member becomes easy.

8 Claims, 10 Drawing Sheets

SHEET FEEDING APPARATUS AND AUTOMATIC DOCUMENT USING THE SAME

BACKGROUND OF THE INVENTION

1. Field of the Invention

This invention relates to a sheet feeding apparatus for separating a plurality of original sheets stacked on a supply tray into a single sheet and for feeding them to a predetermined sheet processing location. The invention also relates to an automatic document feeder that uses the same.

2. Description of the Related Art

An image reading apparatus is designed to optically scan images on an original sheet, convert those images to electronic data and then transmit the data to an image forming apparatus such as a personal computer, facsimile machine or a copier.

Types of methods used to read image data on original sheets in such image reading apparatuses include a stationary document reading method that is a method of moving an optical reading system to acquire image data on a stationary document placed on a reading platen comprised of a clear glass, and a moving document reading method that is a method of using an automatic document feeder (hereinafter referred to as ADF) to separate a plurality of original sheets placed upon a supply tray to feed the original sheets one by one to read image data thereupon.

The ADF is provided with separating means to align leading edges of original sheets placed upon a supply tray, separate them and draw out the uppermost sheet one at a time. A variety of such original sheet separating means have conventionally been introduced and used in the past.

FIG. 10 shows a basic principal of sheet separating means of the prior art. Such mechanisms commonly employ a guide member 503 comprised of an oblique wall surface at a leading end of a tray that stores original sheets. Leading edges of the original sheets stacked against the guide member 503 abut against the oblique surface of the aforementioned guide member 503 thereby staggering and shifting the leading edges of the sheets from front to rear in a feeding direction. The sheets stacked on the tray are separated due to this shift in the front to rear direction and fed to a supply roller 508 side. In the sheets gripped and led between the supply roller 508 and a separation pad 504 which are vertically opposed to each other, the supply roller 508 applies a drawing force on the top sheet to move forward (left direction in the drawing). The second and below sheets are pulled by this force, but prevented from moving forward by the friction of the separation pad 504, thereby allowing only a single sheet to be drawn and supplied in the forward direction. It is also known in the prior art to use a separation roller instead of the aforementioned separation pad 504 to rotate in an opposite direction to the supply roller 508.

Prior art pertaining to such separating mechanisms is disclosed in, for example, Japanese Utility Model Publication (KOKAI) No. 5-83771 and Japanese Patent Publication (KOKAI) No. 10-316265.

Thus, the conventional apparatus for separating stacked original sheets is composed of a feed roller such as a supply roller or a belt, a separation pad pressed against the feed roller and a separating member such as a separating roller. A guide member is provided on the tray so that leading edges of the original sheets abut against an oblique surface to shift the edges in a front to rear direction. However, the prior art has the following problems.

Although the aforementioned guide member should be made of a material having an optimum coefficient of friction to shift leading edges of the original sheets in the front to rear direction, they are conventionally integrated with a tray and made of the same material. Thus, optimum separation is not achieved thereby causing jam or double-feed at the supply roller.

Furthermore, even when a material different from that of the tray is used for the guide member, normally the guide member is required to have a surface with a high coefficient of friction by using materials such as rubber or a specially formed synthetic resin, and an elastic member to attain more preferable separating effect. When materials with a high coefficient of friction are used, these materials tend to wear due to prolonged usage of the apparatus, requiring an occasional replacement of the part. Paper dust sticking to the sheets is known to extremely accelerate the material wear. The conditions of replacement are the same for the separating member described above. Both the guide member and the separating member need to be designed for replacement at an appropriate time.

When these two members, namely the separating member and the guide member, are freely removably mounted to an apparatus frame so that they can be replaced independently due to the need to replace these parts, a new problem such as a jamming problem caused by an error in positioning of the components occurs. A structure for freely removably mounting the two parts to the apparatus frame creates complexity in the apparatus.

OBJECT OF THE INVENTION

It is a first object of the present invention to provide a sheet feeding apparatus in which a slanted guide member that shifts the original sheets stacked on the tray at a distal end of a tray in a front to rear direction, and the separating member, which separates the original sheets one by one, can be respectively made of optimum materials, achieving easy mounting and removal of the two members for replacement.

Another object of the present invention is to further facilitate replacement operation by mounting an integrated holder, in which a guide member and the separating member are integrally assembled to a frame.

Still another object of the present invention is to provide an automatic document feeder incorporated with the sheet feeding apparatus described above.

SUMMARY OF THE INVENTION

The aforementioned objectives can be achieved through the following structures.

To feed a sheet separately, a sheet feeding apparatus comprises a feeding roller, which touches the uppermost surface of the sheets stacked on a sheet supply tray to send out the sheet, and a sheet supply roller to press and supply the drawn out sheet. Components are at least one frame; a sheet stacking tray mounted to this frame; a paper feed rotating body or member which feeds sheets and is disposed at a downstream side of the stacking tray in a sheet feeding direction; a separating member which abuts against the paper feed rotating body to prevent more than one sheet from passing therethrough; urging means for pressing the separating member to the paper feed rotating body; a guide member having an oblique surface to shift leading edges of the sheets and disposed at a leading end of the stacking tray in the sheet feeding direction; a holder member mounted with the separating member and the guide member; and fastening means to freely detachably fasten a separation unit, which is formed of the separating member, the guide member and the holder member, to the frame.

In other words, the guide member and the separating member are mounted to the single holder member that is freely removably fastened to the frame, so that the guide member and separating member are easy to be replaced at any time without requiring adjustment of their mutual mounting positions.

Furthermore, the aforementioned frame can be made of a metallic chassis, or can be a unitized body dually using an apparatus housing as the frame. A spring or some other urging means can be used to fix the fastening means to the frame by pressing against a stopper formed on a portion of the frame.

DESCRIPTION OF THE PREFERRED EMBODIMENTS

Figure 1:
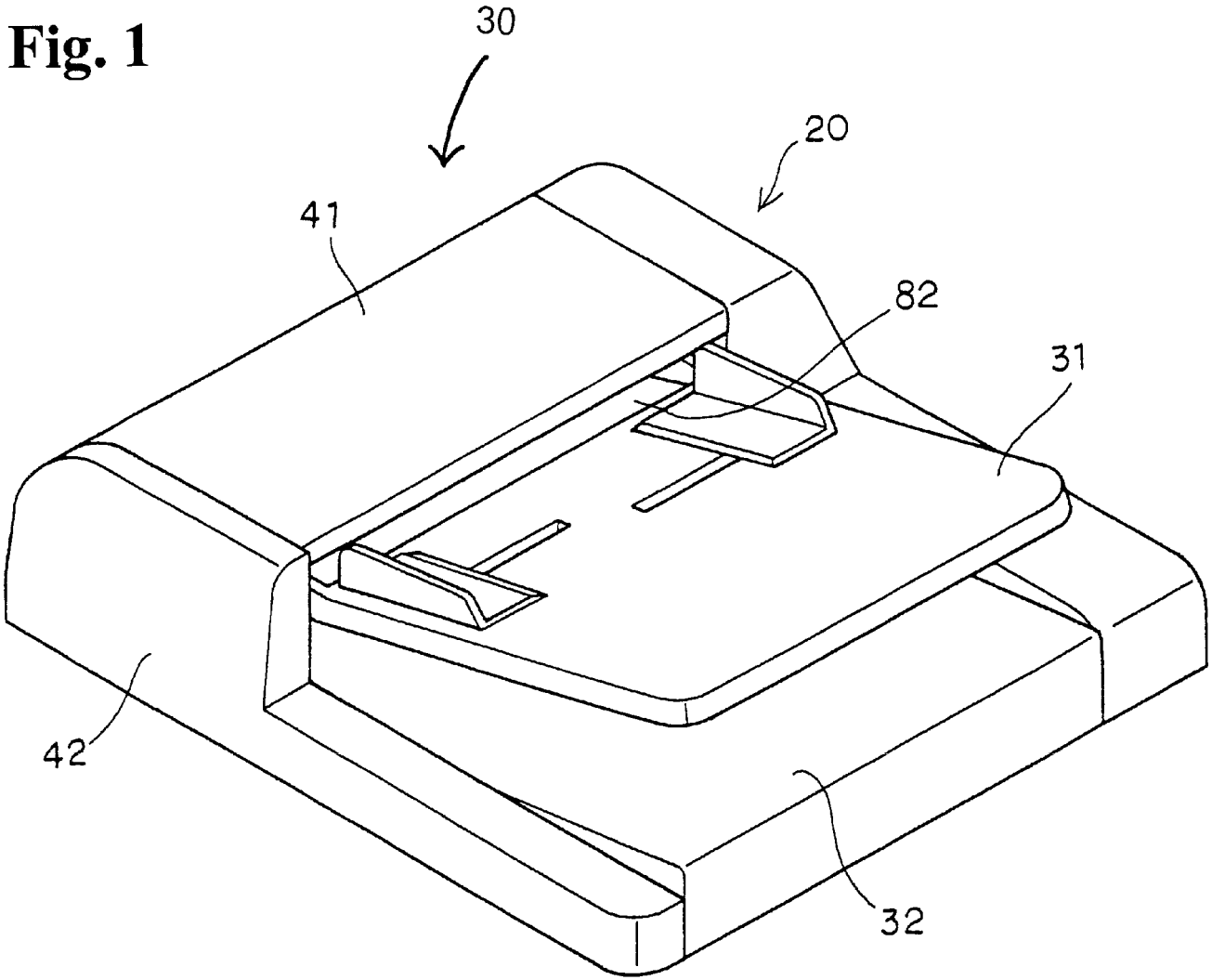
FIG. 1 is an external view of an automatic document feeder provided with a sheet feeding apparatus according to an embodiment of the present invention.
Figure 2:
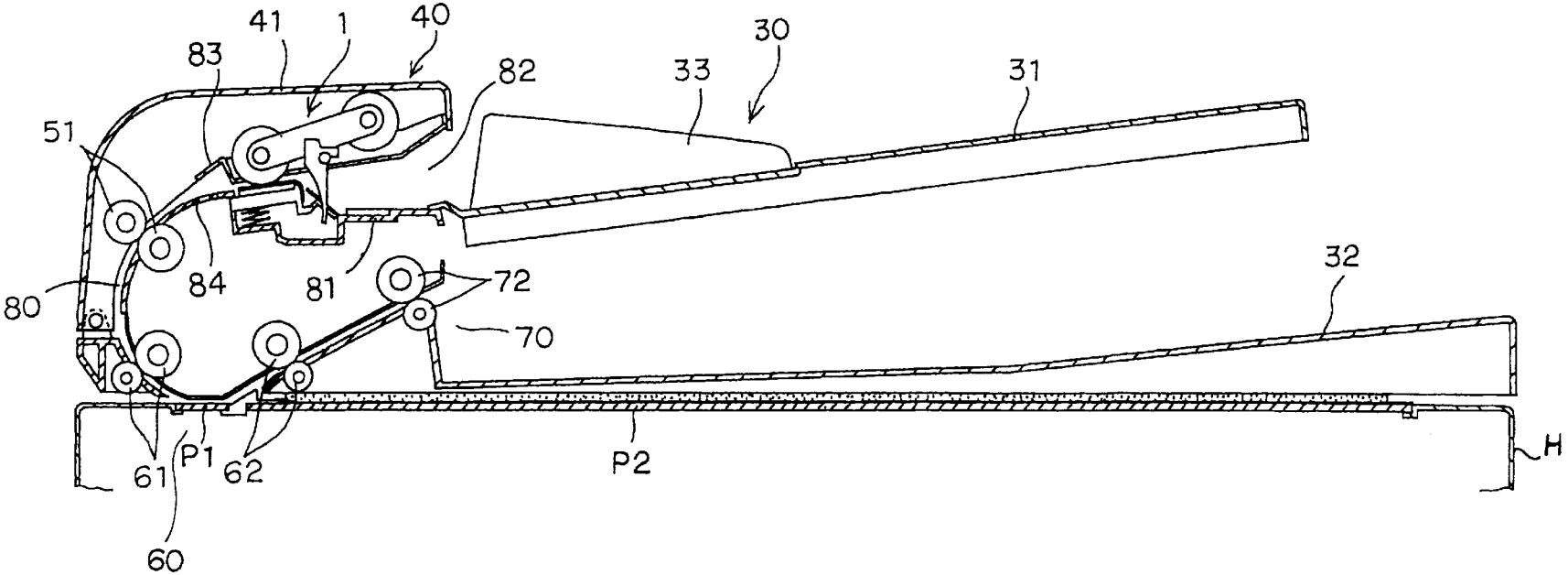
FIG. 2 is a sectional view of the automatic document feeder provided with the sheet feeding apparatus according to the embodiment of the present invention.
Figure 3:
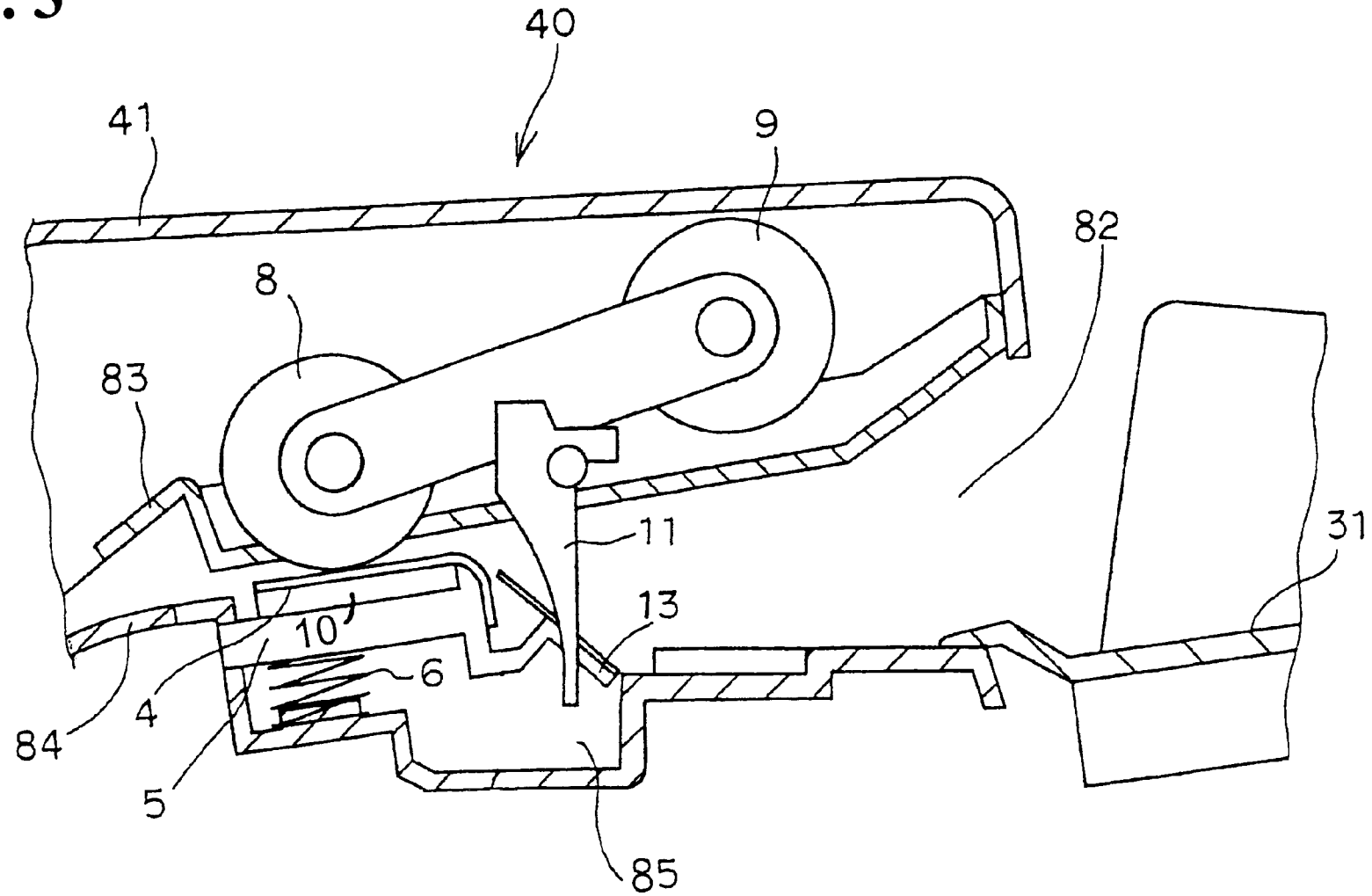
FIG. 3 is a detailed sectional view showing the sheet feeding apparatus provided on the automatic document feeder.

The following is a detailed description of preferred embodiments of an original sheet feeding apparatus according to the present invention based upon the accompanied drawings. FIG. 1 is an external view of an automatic document feeder 30 incorporating the original sheet feed mechanism according to an embodiment of the present invention. FIG. 2 is a sectional view of the automatic document feeder 30. FIG. 3 is a detailed sectional view of a paper feed unit.

The following briefly describes an overall structure of an image reading apparatus and the ADF.

In FIGS. 1 to 3, reference numeral 30 denotes the automatic document feeder apparatus mounted on an image reading apparatus body H. The automatic document feeder 30 comprises a paper feed unit 40 for feeding originals into a housing 20, a transport unit 60 for passing the originals over an upper surface of a contact glass P1 and a discharge unit 70 for discharging the original.

In the image reading apparatus body H mounted to the automatic document feeder 30, light from a light source such as a lamp is irradiated to a transported original through the contact glass P1. The light reflected therefrom is reflected by a mirror and is subjected to a photoelectric conversion by reading means (not shown) such as a CCD thereby reading an image on the original. The image reading apparatus body H is further provided with a contact glass P2 having a surface area capable of placing an original thereupon. By opening and closing the automatic document feeder 30 to place the original on the upper surface of the contact glass P2, and by moving a light source unit (not shown) comprised of a light source and mirrors in a sub-scanning direction, it is also possible to read images on the original through the contact glass P2.

The paper feed unit 40 comprises a supply tray 31 on which sheet originals are stacked; a feed roller 9 that freely moves up and down and contacts an uppermost surface of the sheets stacked on the supply tray 31 by moving down to send out the sheet; a supply roller 8 that supplies the sheet drawn out by the feed roller 9; a separation mechanism 1 including a separation pad 4 for the first upper sheet to pass therethrough but prevent the feeding of second and subsequent sheets; and a pair of register rollers 51 that feeds the sheet further to a downstream side after a leading edge of the sheet separated into one by the separation mechanism 1 abuts to align the leading edge thereof. The paper feed unit feeds the sheets downstream along the paper feed path 80.

The transport unit 60 comprises a pair of transfer-in rollers 61 and a pair of transfer-out rollers 62 disposed before and after the contact glass P1. The transport unit 60 transports the originals along the upper surface of the contact glass P2, so that the originals can be read by reading means positioned below the contact glass P1.

The discharge unit 70 is equipped with a pair of discharge rollers 72 to discharge the originals read on the contact glass P2 to the discharge tray 32.

In this structure, the originals stacked on the supply tray 31 are transported to the contact glass P1 one by one, and discharged to the discharge tray 32 after reading image on the originals are read.

Here, the housing 20 is divided into a first frame 42, which is equipped with a lower portion of the paper feed unit 40, the transport unit 60 and the discharge unit 70; and a second frame 41 equipped with an upper portion of the paper feed unit 40 and used as an outer cover.

A part of the first frame 42 forms a curved lower frame guide 84 to guide the originals inserted in a paper feed entrance 82 of the paper feed path 80 toward the contact glass P1. A part of the second frame forms an upper frame guide 83.

Figure 4:
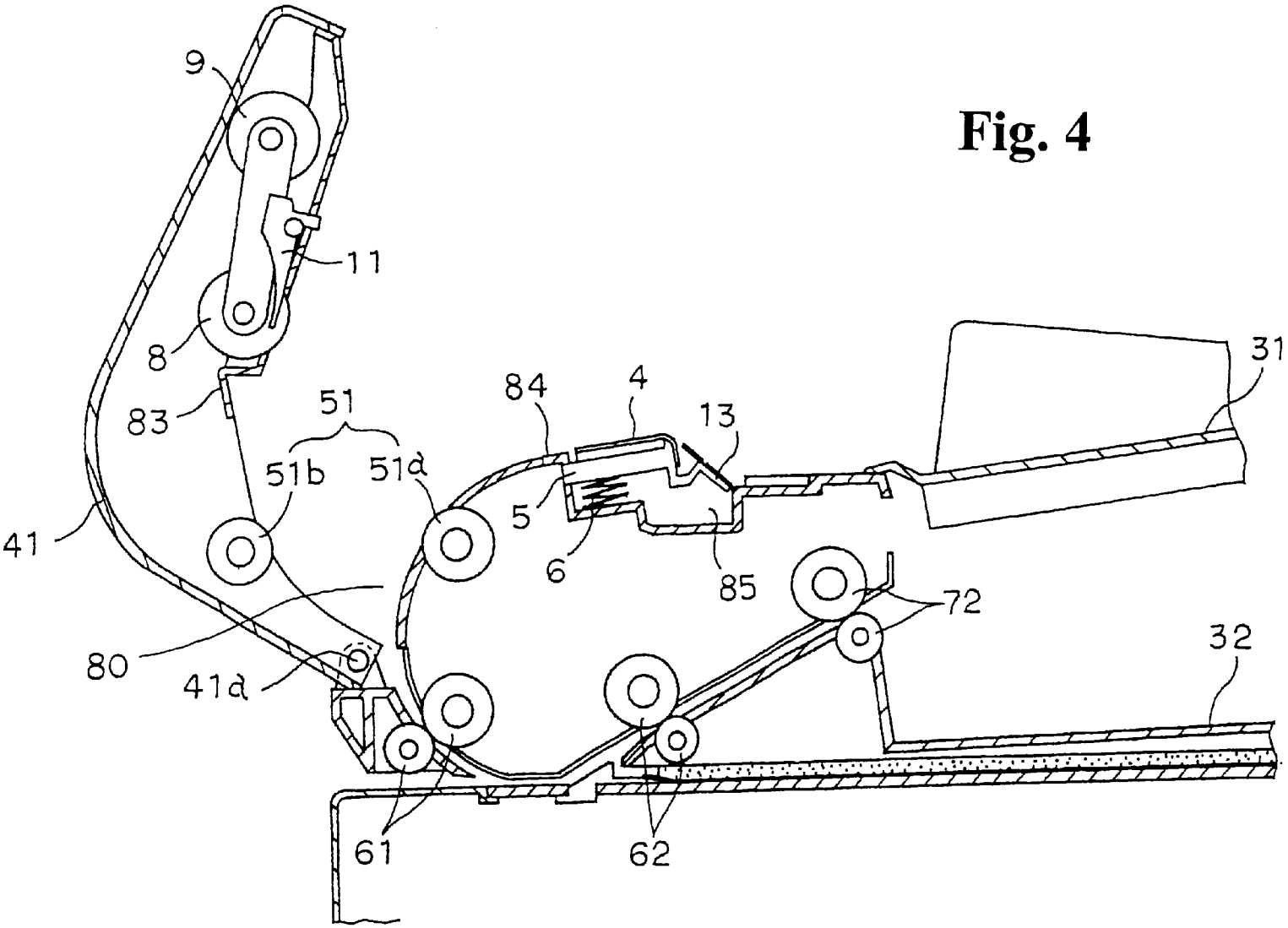
FIG. 4 is a sectional view of the automatic document feeder with an outer cover opened.

The second frame 41 is mounted to the second frame 42 to be rotatable on a pivot 41*a* on as shown in FIG. 4.

The feed roller 9, the supply roller 8 and a driven roller 51*b* of a pair of the register rollers 51 are mounted on the second frame 41, and rotate as a single body along with the second frame 41. Accordingly, the paper feed path 80 can be opened by rotating the second frame 41 to expose an original feeding surface of the lower frame guide 84, 50 that jammed sheets can be removed.

The first frame 42 is configured by the lower frame guide 84, which is attached to the frame side plate on the apparatus mounted with a pair of transfer-in rollers 61, a pair of the transfer-out rollers 62, and a pair of the discharge rollers 72; and a pair of frame guides forming a transport path and a discharge path. The discharge tray 32 is integrally formed therewith.

In the lower frame guide 84, which constitutes a part of the first frame 42, there is formed a concave portion (opening part) where a separation unit 2, which is described later, is freely detachably attached.

Figure 5:
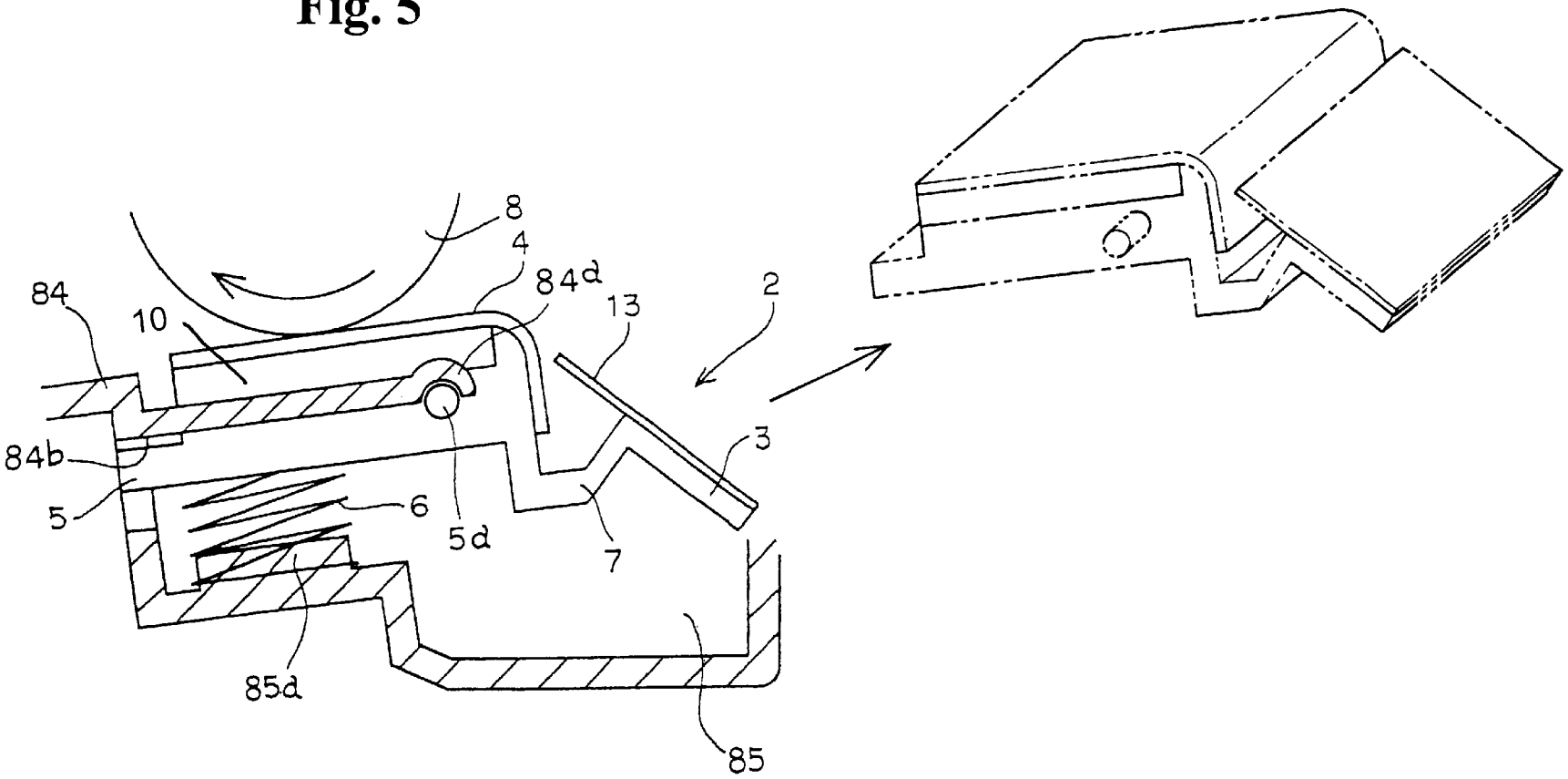
FIG. 5 is a sectional view showing an essential portion of a separation mechanism of a paper feed unit on the automatic document feeder.

Next, with reference to FIG. 3 and FIG. 5, the separation mechanism 1 of the paper feed unit according to the present invention will be explained in detail.

The separation mechanism 1 comprises the aforementioned supply roller 8 and the separation unit 2. The separation unit 2 further comprises the separation pad 4 that presses against the supply roller 8; an elastic member 10 to which the separation pad 4 is attached; a pad holder 5 to which the separation pad 4 and the elastic member 10 are mounted as a single unit; an urging spring 6 which urges the pad holder 5 to press the separation pad 4 against an outer surface of the supply roller 8; and a front separation member 13 to separate and guide the originals at an upstream side of the separation pad 4.

The separation pad 4 has a surface made of urethane rubber with a high coefficient of friction, and in the present embodiment of the invention, the urethane rubber forms a belt and is mounted by coupling an upstream end thereof in the sheet feeding direction with a side of the pad holder 5. A width of the separation pad 4 is either the same as an axial width of the feed oiler or larger by approximately 1 to 2 mm so that a transporting force of the supply roller 8 is not hindered.

The elastic member 10 is formed of a sponge rubber so that the separation pad 4 formed with the sheet-shaped urethane rubber can deform along the outer surface of the supply roller 8. This increases a contact area between the separation pad 4 and the supply roller 8, thus the pressing force per unit area of the separation pad 4 against the supply roller 8 is reduced thereby preventing damage and smear of the original without impairing the separating performance.

The front separation plate 13 is mounted to the pad holder 5 such that the front separation plate is inclined upwardly in the draw-out direction of the original. The front separation member 13 prevents a large amount of documents from being fed between the supply roller 8 and the separation pad 4 by shifting leading edges of a bundle of the sheets and separating the sheets. Also, the front separation member 13 forms a part of the lower frame guide 84 and also has functions to guide the original sheets to a nip section between the feed roller and the separating member.

Incidentally, it is preferred that the front separation plate be composed of a member, of which a surface for guiding the document has a high coefficient of friction, such as a plate-shaped rubber member. However, it is also acceptable to be a resin member such as Mylar. Also, it is acceptable to use a low coefficient of friction member such as Mylar for a lower end portion of the front separation plate and a high coefficient of friction member such as rubber for an upper end portion of the front separation plate at a downstream side thereof in the sheet feeding direction. In other words, it is possible to select a material that can appropriately handle the originals and guide several sheets thereof to the separation mechanism 1 as the front separation plate.

One end of the urging spring 6 used as an urging member is mounted to a protrusion 85*a* established on a bottom of the concave portion 85 of the lower frame guide 84, and the other end of the urging spring 6 abuts against a surface of the pad holder 5, which is different from a surface attached to the cushioning member 10 and the separation pad 4, to urge the pad holder 5 upward and press the separation pad 4 to the outer surface of the supply roller 8. The urging position is set to urge a position further downstream in the sheet feeding direction than a contact position of the supply roller 8 and separation pad 4. Under a normal condition, the separation pad 4 is pressed and fixed to the outer surface of the supply roller 8 by the urging spring 6.

The pad holder 5 has engaging pins 5*a* respectively on both side surfaces at the upstream side in the sheet feeding direction, and the engaging pins 5*a* are formed to engage attachment parts 84*a* formed on the lower frame guide 84. By means of the attachment part 84*a* and a contact part 84*b* at a bottom surface of the lower guide, the separation unit 2 is restricted to a predetermined position by the urging spring 6 even if the supply roller 8 is separated away from the separation pad 4 when the outer cover 41 is opened.

To describe how the pad holder 5 is mounted and removed, the outer cover 41 rotates to separate the supply roller 8 from the separation pad 4, and the lower frame guide 84 is exposed. Then, in this condition, the pad holder 5 is pushed down against a force of the urging spring 6 so that the engaging pins 5*a* are pushed lower than a leading edge of the attachment part 84*a* at the upstream side in the sheet feeding direction. Lastly, by pulling toward the upstream side in the feeding direction, the pad holder 5 can be removed from the concave portion 85 of the lower frame guide 84, as shown by phantom line in FIG. 5.

Also, when mounting, the pad holder 5 is inserted into the concave portion 85 of the lower frame guide 84 from a position lower than the leading edge of the attachment part 84*a* at the upstream side in the sheet feeding direction, and by pulling toward at the upstream side in the sheet feeding direction at the attachment parts 84*a,* the engaging pins 5*a* engage the attachment parts 84*a.*

As described above, the cushioning member 10 mounted on the pad holder 5, the separation pad 4 and the front separation member plate 13 positioned before the separation pad 4 are integrated as a single unit, and the structure enables the easy mounting and removal from the inclined surface of the lower frame guide 84 at the upstream side in the sheet feeding direction. Therefore, replacement of the separation pad 4 is not cumbersome.

The following will describe a supply operation of the paper feed unit 40.

When an original bundle is inserted into the paper feed entrance 82 from a position on the supply tray 31, a leading edge of the original bundle abuts against the stopper 11 to be restricted. Accordingly, the leading edge of the original bundle is restricted and moves to the draw-out position on the supply tray 31. When a feed instruction is received from a main unit such as the image reading apparatus, the feed roller 9 is lowered to touch the uppermost surface of the original bundle.

Accompanied with the lowering operation of the feed roller 9, the stopper 11 retracts from the paper feed entrance 82 to open the paper feed entrance 82.

The feed roller 9 rotates, draws out an original from the original bundle on the supply tray 31 and sends it to the paper feed path 80. When the feed roller 9 touches the uppermost sheet and rotates, normally, subsequent several sheets below the uppermost sheet also follow into the paper feed path 80 due to a frictional force between the sheets.

The leading edges of almost all the sheets abut against the inclined surface of the front separation member 13 and are stopped. In other words, the front separation plate 13 of the front separation member 3 shifts the leading edges of the sheets by a frictional force between the original sheets and the front separation plate, and separates the original sheets into a few sheets to guide them further.

In this way, a few of the original sheets separated by the front separation plate 13 are transported to the nip portion between the supply roller 8 and the separation pad 4. At this position, only the uppermost original sheet is fed by the supply roller 8, and the second and subsequent sheets are stopped by frictional resistance of the separation pad 4.

Subsequently, the leading edge of the separated single original sheet abuts against a pair of the register rollers 51 to be aligned, and the original sheet is fed toward the contact glass P1.

When the rubber on the separation pad 4 wears and loses frictional resistance due to rubbing the original sheets, the pad holder 5 can be pulled out along with the front separation member 3 and replaced.

Figure 6:
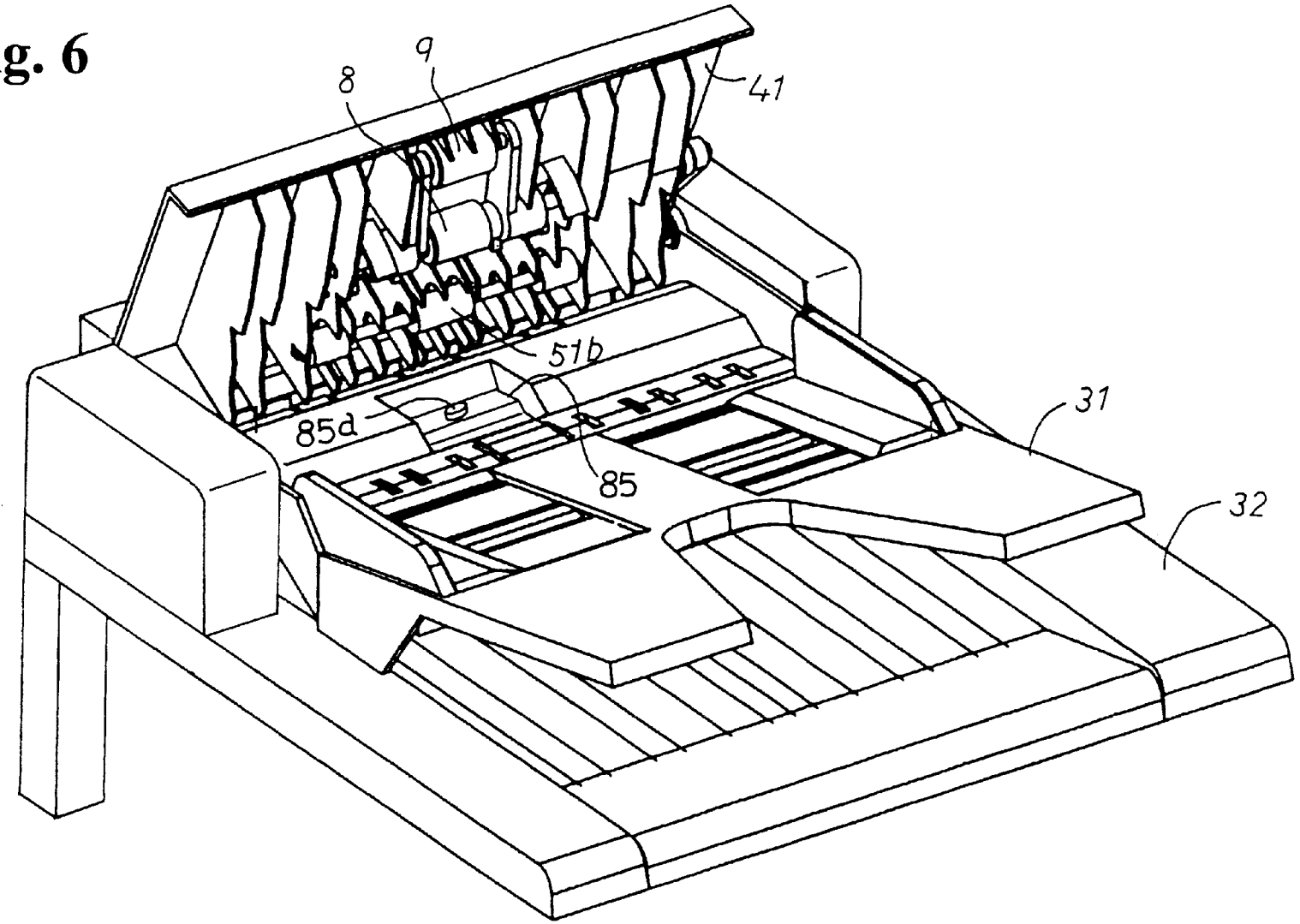
FIG. 6 is a perspective view showing the automatic document feeder with the outer cover opened and the separation mechanism removed.

FIG. 6 shows a perspective view when the outer cover 41 is opened and the separation unit 2, which is integrated with the pad holder 5 and the front separation member 3, is removed.

Figure 7:
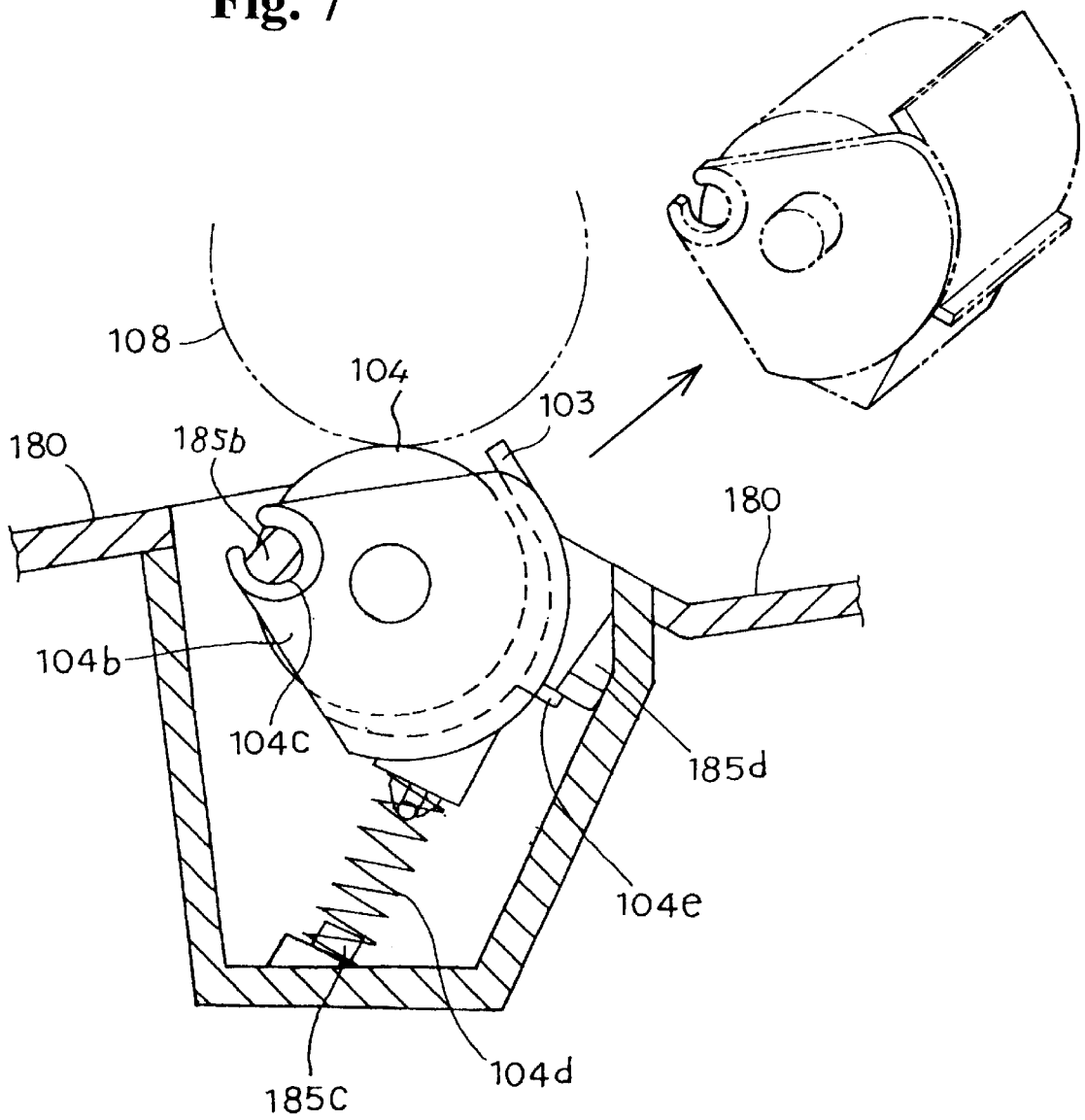
FIG. 7 is a sectional view showing an essential portion of a second embodiment of the present invention.

FIG. 7 is a sectional view showing an essential portion of a second embodiment of the present invention.

The separation member is composed of a separation roller 104, which has a surface with a high coefficient of friction and is made of a cylindrical rubber member.

The separation roller is supported so that an upper portion thereof protrudes into a semi-circular-shaped separation bracket 104*b*.

A front separation member 103 having an inclined surface is disposed before the separation roller 104 on the separation bracket 104*b* to separate an original and guide it to a nip between a supply roller 108 and the separation roller 104.

The separation bracket 104*b* is rotationally supported on support pins 185*b* through an engagement between an engaging part 104*c* formed at downstream in a sheet feeding direction and the support pin 185*b* formed on both side surfaces inside a concave part 185 of a lower frame guide 180.

Under the separation bracket 104*b*, an urging spring 104*d* engages a protrusion 185*c* protruding from a bottom of the concave part 185 of the lower frame guide 180, and constantly urges to rotate the separation bracket 104*b* upward around the support pin 185*b* as a pivot. By urging the separation bracket 104*b* to rotate, the separation roller 104 is pressed against the supply roller 108.

Also, the separation bracket 104*b* is provided with a stopper pawl 104*e*, which abuts against a regulating part 185*d* formed on a side inside the concave part 185 at upstream in the sheet feeding direction, to regulate a rotation of the separation bracket 104*b* such that the separation bracket 104*b* is not pushed out of the concave part 185 by an urging force of the urging spring 104*d* when the outer cover is rotated and the supply roller 108 is separated from the separation roller 104.

The separation roller 104 has a torque limiter mounted to a rotating shaft such that the separation roller 104 rotates when torque applied thereto is under a predetermined value, and will not rotate when an applied torque exceeds this predetermined value. In other words, the torque limiter is set such that when only one original is inserted to the nip between the supply roller 108 and the separation roller 104, the separation roller 104 rotates following a movement of the original because torque is low. When two or more sheets are inserted, the separation roller 104 is fixed to prevent the feeding of the second or subsequent sheets because the torque increases. This torque limiter can improve separating performance.

Figure 8A:
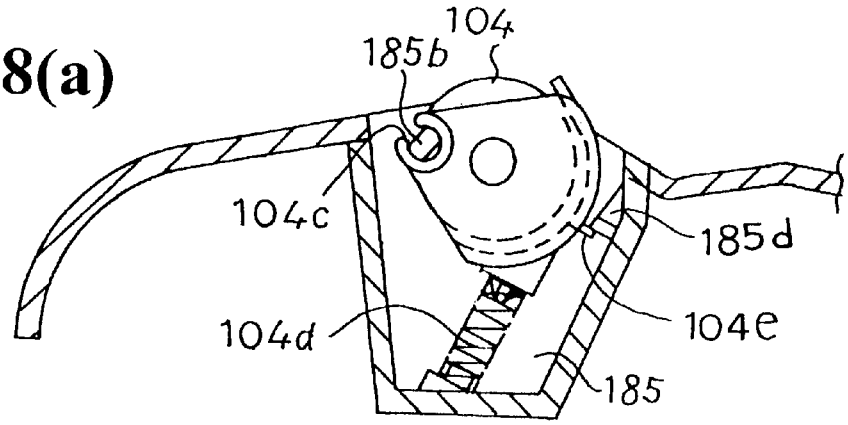
FIGS. 8(*a*)–8(*c*) are conceptual views showing a replacement operation of the separation mechanism according to the second embodiment of the present invention.
Figure 8B:
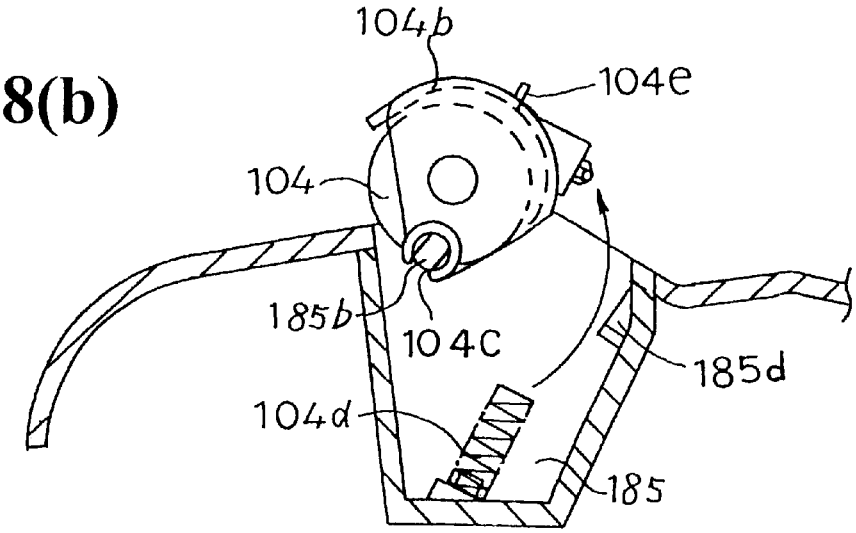
Figure 8C:
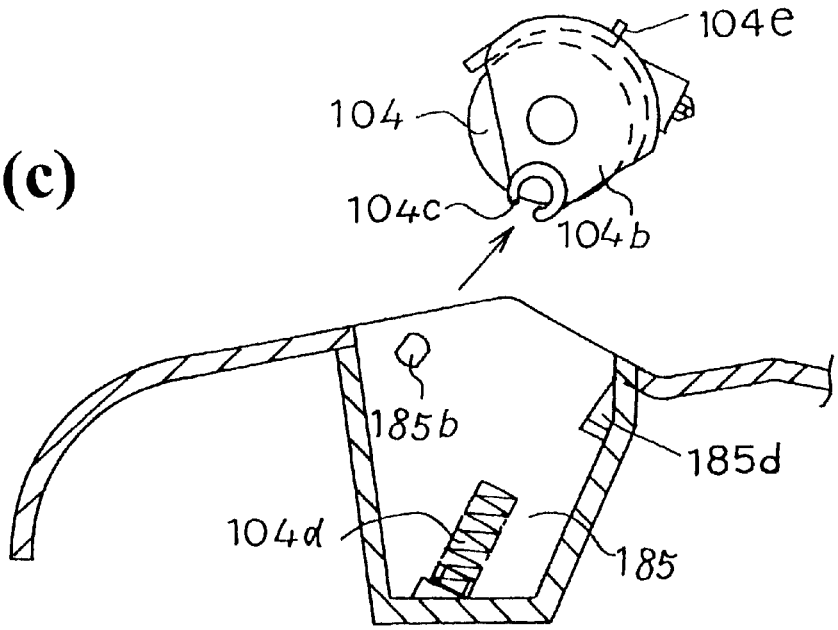

FIGS. 8(*a*)–8(*c*) show conceptual views showing a replacement of the separation pad 4.

In explaining a method of separating and attaching the separation bracket 104*b* based on FIGS. 8(*a*)–8(*c*), when the outer cover is rotated to separate the supply roller 108 from the separation roller 104, the lower guide 180 is exposed. In this state, the stopper pawl 104*e* on the separation bracket 104*b* abuts against the regulating part 185*d* on the concave part 185 of the lower guide 180, 50 that the separation bracket 104*b* is restricted inside of the concave part 185 (see FIG. 8(*a*)).

From this state, the stopper pawl 104*e* disposed on the separation bracket 104*b* is bent and deformed downward by a tool such as a driver or the like to release the restriction by the regulating part 185*d* on the concave part 185 of the lower guide 180. Then, the separation bracket 104*b* rotates upward to an outside of the concave part 185 (see FIG. 8(*b*).). After this, the engaging part 104*c* on the separation bracket 104*b* is disengaged from support pins 185*b* inside of the concave part (opening section) 185 on the lower guide 180. (See FIG. 8(*c*).)

When mounting, the engaging part 104*c* on the separation bracket 104*b* abuts against the support pins 185*b* inside the concave part 185 on the lower guide 180, and the separation bracket 104*b* rotates downward around the support pin 185*b* as a pivot. The stopper pawl 104*e* on the separation bracket 104*b* abuts against a side of the regulating part 185*d* to be bent and deformed, and when the stopper pawl 104*e* reaches a position under the regulating part 185*d* it returns back to its original shape. Then, the stopper pawl 104*e* on the separation bracket 104*b* abuts against the regulating part 185*d* on the concave part 185 of the lower guide 180, so that the separation bracket 104*b* is restricted inside the concave part 185.

As described above, the support pins 185*b* are disposed inside the concave part 185, and the engaging part 104*c* to engage the support pins 185*b* is disposed on the separation bracket 104*b*. Further, the separation bracket 104*b*, the separation roller 104 and the front separation member 103 can be mounted or detached as a single body to the concave part 185 by rotating around the support pins 185*b*, so that the operation of replacing the separation pad 4 is not cumbersome, and carried out.

Figure 9:
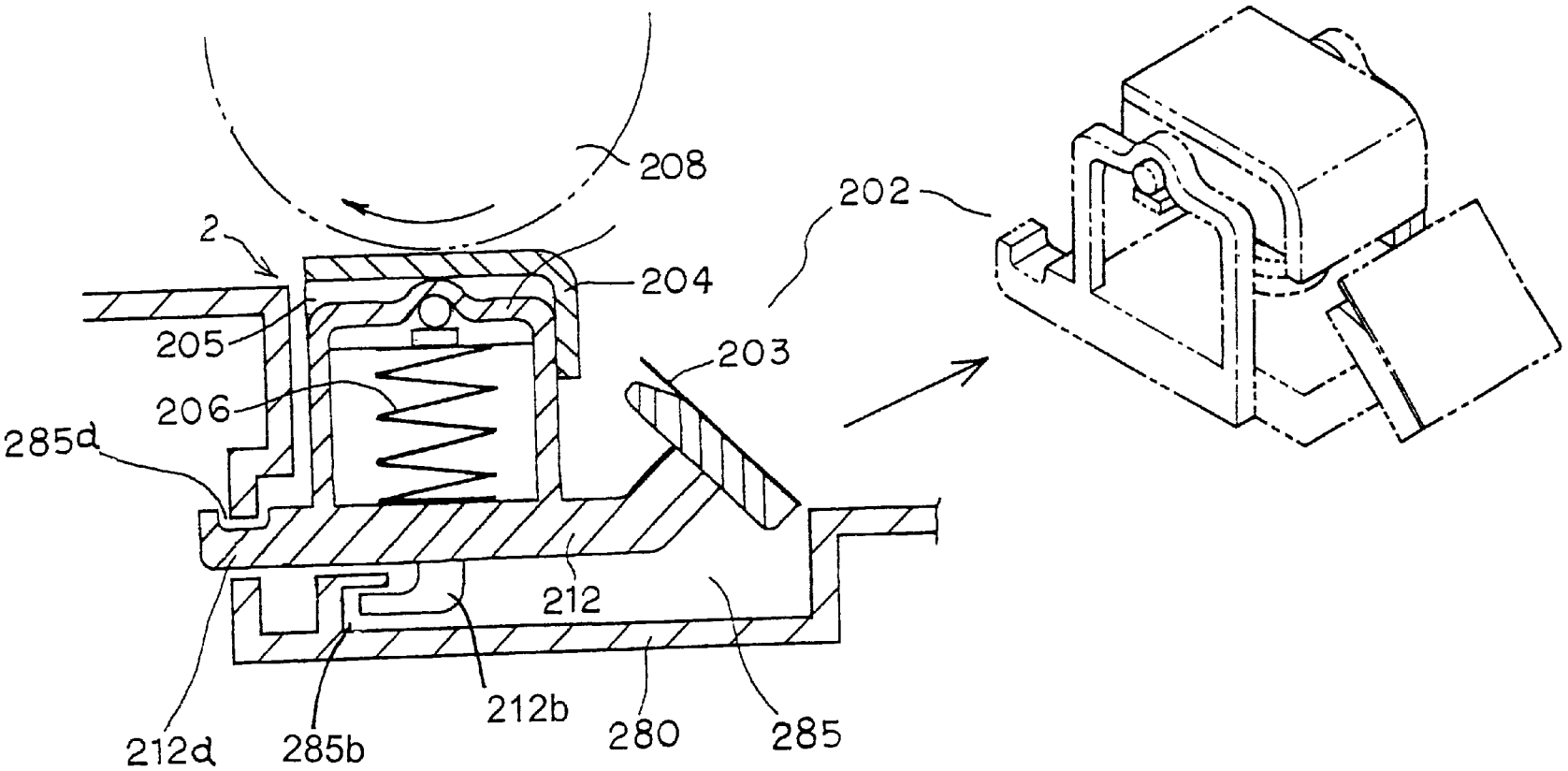
FIG. 9 is a sectional view showing an essential portion of a third embodiment of the present invention.
Figure 10:
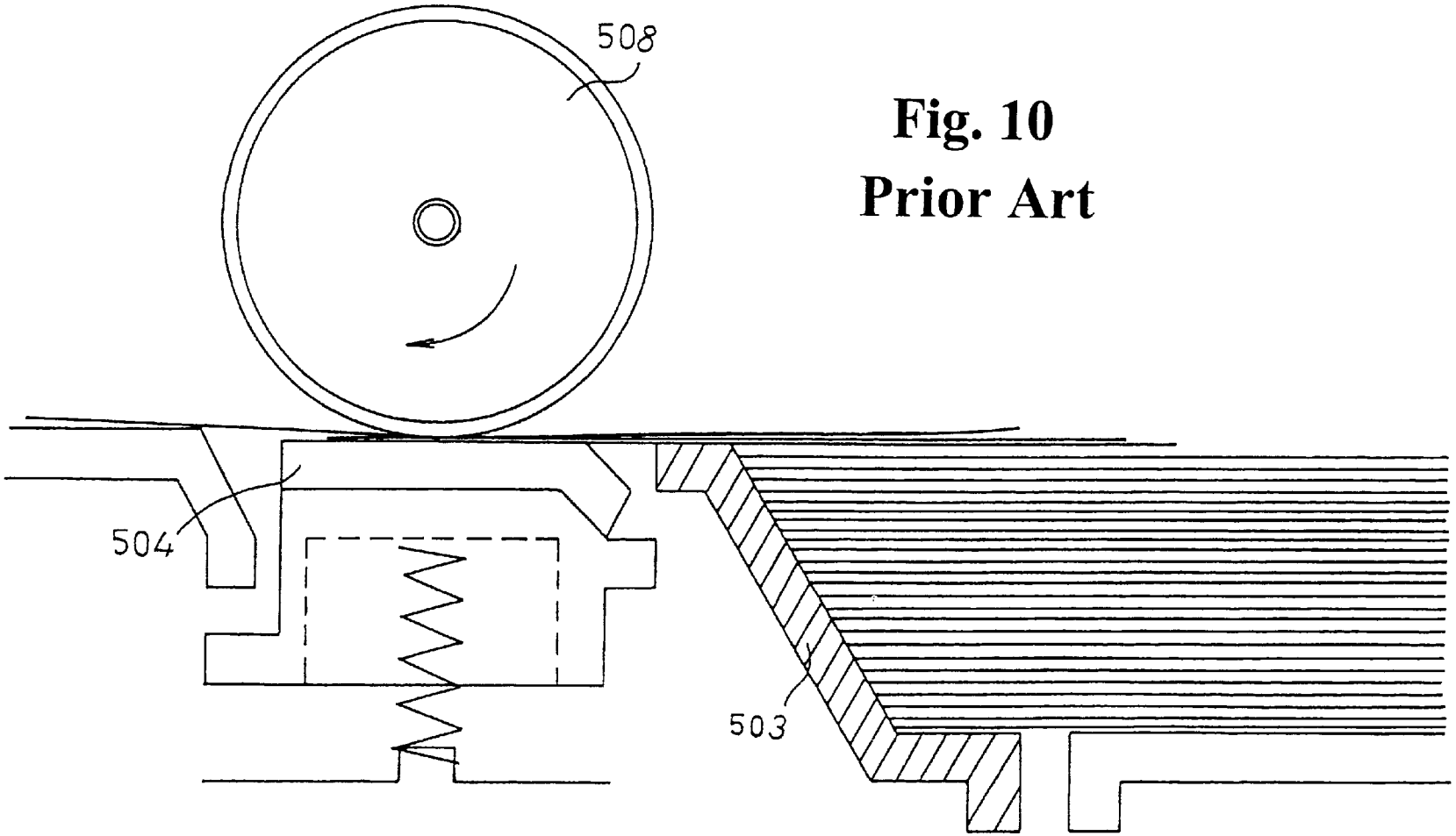
Fig. 10 Prior Art
FIG. 10 is a conceptual view showing a conventional sheet feeding apparatus.

FIG. 9 is a sectional view showing an essential portion of a third embodiment of the present invention.

According to this embodiment of the present invention, an original separation unit 202 comprises a separation pad 204 and a pad holder 205 as a single unit. A front separation member 203 and a front separation holder 212 are composed into a single body. Also, an urging spring 206 is disposed between the pad holder 205 and the front separation holder 212.

The front separation holder 212 has a regulating part 212*b* that restricts the separation pad 204 and pad holder 205 moving upward by the urging spring 206. The regulating part 212*b* is comprised so that the pad holder 205 and the front separation holder 212 become a single unit by an upward urging force of the urging spring 206.

Also, on the front separation holder 212 are formed an engaging part 212*a* and the regulating part 212*b* that engage attachment parts 285*a* and 285*b* on the concave part 285 of the lower guide 280. By inserting the engaging part 212*a* and the regulating part 212*b* into the attachment parts 285*a* and 285*b* formed on the concave part 285, the front separation holder 212, the pad holder 205 and the urging spring 206 can be mounted as a single unit to the concave part 285 on the lower guide 280.

Incidentally, phantom lines in the FIG. 9 indicate a state in which the separation unit 202 is removed.

The other structures are the same as those in the first embodiment.

In the embodiments described above, the separation member and the separation plate are configured into a single unit, and the separation position and the front separation position are consistent to ensure stable separation performance, resulting in smooth and stable supply of sheets. Furthermore, as the separation member and the front separation plate are structured as a single body to be freely detachable and attached to the entrance, workability in replacing the separation member is extremely improved.

What is claimed is:

1. A sheet feeding apparatus for separating and feeding sheets one by one, comprising:

at least one frame having a wall surface;

a sheet stacking tray mounted to said frame for stacking the sheets so that leading edges of the sheets on the stacking tray abut against the wall surface in a sheet feeding direction;

a paper feed rotating member for feeding the sheets disposed at a downstream side of said stacking tray in the sheet feeding direction;

a separating member pressed against said paper feed rotating member for preventing more than one sheet from passing therethrough;

urging means for pressing said separating member to the paper feed rotating member;

a guide member having an inclined surface for shifting the leading edges of the sheets and disposed to face the stacking tray in the sheet feeding direction, at least a part of said guide member being made of a material with a coefficient of friction higher than that of the wall surface of the frame; and a holder member mounted with the separating member and the guide member so that the separating member, the guide member and the holder member form a separating unit freely detachably fastened with fastening means to the frame.

2. A sheet feeding apparatus according to claim 1, wherein said frame is formed integrally with a housing of the apparatus, said housing comprises a unitized body, and said separating unit is fastened to said housing by the fastening means.

3. A sheet feeding apparatus according to claim 1, wherein said fastening means comprises a spring, and said unit is pressed against the paper feed rotating member mounted on the frame by the spring mounted to the frame.

4. A sheet feeding apparatus according to claim 1, wherein the paper feed rotating member is disposed to a first frame mounted with the separation unit and a second frame different from the first frame, and said second frame is formed as a part of a housing and interlocked to the first frame to be freely capable of opening and closing.

5. A sheet feeding apparatus according to claim 1, wherein said separating member has substantially a same width as a width of the paper feed rotating member in a sheet transfer direction.

6. A sheet feeding apparatus according to claim 1, wherein said guide member comprises a plate-shaped elastic member providing an elastic deformation in the sheet feeding direction.

7. An automatic document feeder apparatus disposed above a reading platen of an image reading apparatus to sequentially feed original sheets to the reading platen, comprising;

at least one frame;

an original sheet stacking tray mounted to the at least one frame;

a guide member disposed at a leading edge of the stacking tray in a sheet feeding direction and having an inclined surface to shift leading edges of the sheets;

a paper feed rotating member disposed at a downstream side of the stacking tray in the sheet feeding direction and feeding the sheets;

a separating member pressed against the paper feed rotating member to prevent passing of more than one sheet, said separating member and the guide member being attached to a single holder member;

urging means for urging the separating member to press against the paper feed rotating member;

a curved transport path for guiding the original sheets from the paper feed rotating member to the reading platen;

a discharge tray for storing the original sheets from the reading platen; and fixing means for freely detachably fixing a separation unit formed of the separating member, guide member and the holder member to the frame.

8. A sheet feeding apparatus for separating and feeding sheets one by one, comprising:

at least one frame;

a sheet stacking tray mounted to said frame;

a paper feed rotating member for feeding the sheets disposed at a downstream side of said stacking tray in a sheet feeding direction;

a separating member formed of a roller member and pressed against said paper feed rotating member for preventing more than one sheet from passing therethrough;

urging means for pressing said separating member to the paper feed rotating member;

a guide member having an inclined surface for shifting leading edges of the sheets and disposed to face the stacking tray in the sheet feeding direction; and a holder member mounted with the separating member and the guide member and formed of a bracket to support the roller member so that the separating member, the guide member and the holder member form a separating unit freely detachably fastened with fastening means to the frame.

* * * * *